US005932823A

United States Patent [19]

Jacobs

[11] Patent Number: 5,932,823

[45] Date of Patent: Aug. 3, 1999

[54] DRUM PRACTICE PAD AND METHOD OF PRODUCTION

[76] Inventor: Malcolm W. Jacobs, 10221 W. 9th Dr., Lakewood, Colo. 80215

[21] Appl. No.: 09/018,803

[22] Filed: Feb. 4, 1998

Related U.S. Application Data

[60] Provisional application No. 60/037,827, Feb. 5, 1997.

[51] Int. Cl.[6] ..... G10D 13/02

[52] U.S. Cl. ..... 84/411 P; 84/452 P; 428/423.1; 428/411.1; 528/503

[58] Field of Search ..... 84/411 P, 452 R, 84/452 P; 428/411.1, 423.1; 528/44, 480, 502 R, 503

[56] References Cited

U.S. PATENT DOCUMENTS 4,406,207 9/1983 Criscione ..... 84/411 P

*Primary Examiner*—William M. Shoop, Jr.
*Assistant Examiner*—Shih-yung Hsieh
*Attorney, Agent, or Firm*—Law Offices of Royal W. Craig

[57] ABSTRACT

A drummer's practice pad and method for production thereof. The practice pad very closely simulates an actual drum head (the striking surface is as close to actual drumskin as possible), and this allows more efficient practice in the following areas: stick control on the pad surface; finger and hand development; and uniform stick response and rebound. The pad includes a cylindrical practice pad base having a shallow upper recess into which an elastomer pad compound is poured. The pad compound self-levels and hardens in a thin layer to provide an improved striking surface. A polyurethane coating is then applied. This improved striking surface is very realistic of an actual drumskin, and it muffles sound without muting it. It is durable and will not wear out or become depressed. Moreover, the process for making the pad is well-suited for mass production since it is simple and employs readily available materials.

2 Claims, 5 Drawing Sheets

DRUM PRACTICE PAD AND METHOD OF PRODUCTION

CROSS-REFERENCE TO RELATED APPLICATIONS

The present application claims priority from the U.S. Provisional Patent Application of Jacobs, Malcolm W. for his "DRUM PRACTICE PAD AND METHOD OF PRODUCTION"; filed: Feb. 5, 1997; Ser. No. 60/037,827.

BACKGROUND OF THE INVENTION

1. Field of the Invention

The present invention relates to practice pads for practicing drumming and, in particular, to an improved pad construction and method of production thereof which gives a more durable, sound-muffling pad having a more realistic response or "feel" as can be appreciated by the advanced player.

2. Description of the Background

Drum practice pads offer drummers a way of practicing by which noise is reduced to an acceptable level. However, quality practice time is best spent with a pad that realistically duplicates an actual drum in all respects. The pad should muffle the sound without adversely affecting tonal quality. In addition, the pad must give a realistic "feel" that approaches an actual drumhead. Furthermore, the pad must be structurally stable and not prone to shifting. A variety of prior art drum practice pads have been developed which incorporate various compositions of felt or soft rubber, and which can be placed directly on a drum playing head or mounted separately.

For example, U.S. Pat. No. 5,520,090 to Eagle shows a drum practice set including a pad that is constructed of a transparent plastic upper layer (e.g., LEXAN™) and a resilient soft plastic or rubber lower layer (e.g., Neoprene™) (see column 4, lines 1–19).

U.S. Pat. No. 5,492,047 to Oliveri shows a removable drum head noise reducer including a removable drumhead insert (see FIG. 4) filled with inner layers 22, 23 for muffling sound. The inner layers may be, e.g., Styrofoam™.

U.S. Pat. No. 4,581,973 to Hoshino shows a pad for an electronic drum including a sponge rubber buffer pad (FIG. 1, ref. 25).

U.S. Pat. No. 4,179,974 to Trankle shows a practice pad having a heavy layer of metal or the like sandwiched between two flat sheets of gum rubber.

U.S. Pat. No. 4,102,235 to Le Masters shows a drum practice pad to be seated on a conventional drumhead for absorbing sound. This practice pad employs a leather layer and optional rubber layer.

U.S. Pat. No. 3,597,520 to Andrews shows a drum practice pad to be seated on a conventional drumhead. This practice pad employs a base portion and an upper layer of gum rubber.

U.S. Pat. No. 1,346,588 to Bower shows a practice pad having a layer of felt or the like covered by a thin plate of stiff material.

While the above-described prior art pads suggest a wide range of materials (e.g., leather, gum rubber, LEXAN, sponge rubber including Neoprene, Styrofoam, or the like), these pads have inherent shortcomings. The harder pad materials fail to effectively muffle the sound to an acceptable "practice" level. The softer pad materials alter the tonal quality and are not realistic. None of these pads give a realistic "feel", e.g., a response akin to that of an actual drumhead.

It would be greatly advantageous to develop a drum practice pad and method of construction thereof which realistically duplicates an actual drum in all respects. The improved pad should give a realistic "feel" which approaches that of an actual drumhead, and which muffles sound to an acceptable level without adversely affecting the tonal quality of the muffled sound. It would also be advantageous to provide a practice pad which can rest on existing drum heads for practice purposes, or which can be anchored to a base for mounting on any conventional stand, surface, or other position-holding fixture.

SUMMARY OF THE INVENTION

According to the present invention, the above-described and other objects are accomplished by providing a drummer's practice pad and method for production thereof. The practice pad includes a cylindrical practice pad base having a shallow upper recess into which an elastomer pad compound is poured. The pad compound self-levels and hardens in a thin layer to provide an improved striking surface. A polyurethane coating is then applied. This improved striking surface is very realistic of an actual drumskin, and it muffles sound without muting it. It is durable and will not wear out or become depressed. Moreover, the process for making the pad is well-suited for mass production since it is simple and employs readily available materials.

BRIEF DESCRIPTION OF THE DRAWINGS

Other objects, features, and advantages of the present invention will become more apparent from the following detailed description of preferred embodiments and certain modifications thereof when taken together with the accompanying drawings in which.

DETAILED DESCRIPTION OF THE PREFERRED EMBODIMENTS

The present invention includes a drum practice pad which realistically duplicates an actual drum in all respects, and a method for making the same. The pad of the present invention gives an extremely realistic "feel" which simulates that of an actual drumhead. The pad muffles sound to an acceptable level, but does not adversely affect the tone or quality of the muffled sound.

Figure 1:
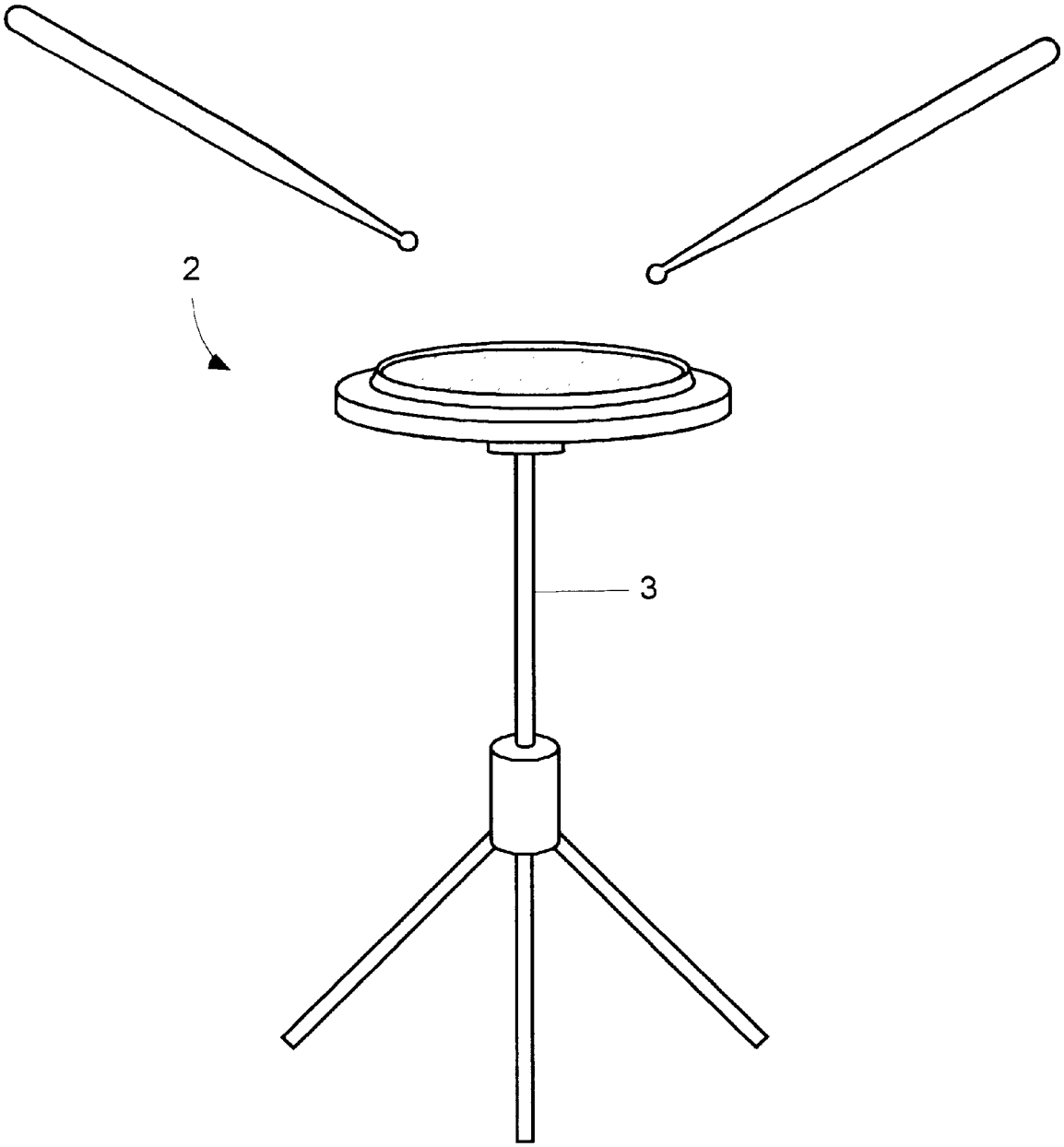
FIG. 1 is a front perspective drawing of a conventional drum with a practice pad 2 according to the present invention seated thereon.

FIG. 1 illustrates one embodiment of the practice pad 2 according to the present invention mounted on a conventional instrument stand 3 for practice purposes. Practice pad 2 is a generally flat circular disk. The specific dimensions of practice pad 2 may be varied as a matter of preference. Currently, at least 6", 8" and 10" diameter pads 2 are envisioned, and it is also contemplated that multiple pads 2 of various sizes will be sold in sets.

Figure 2:
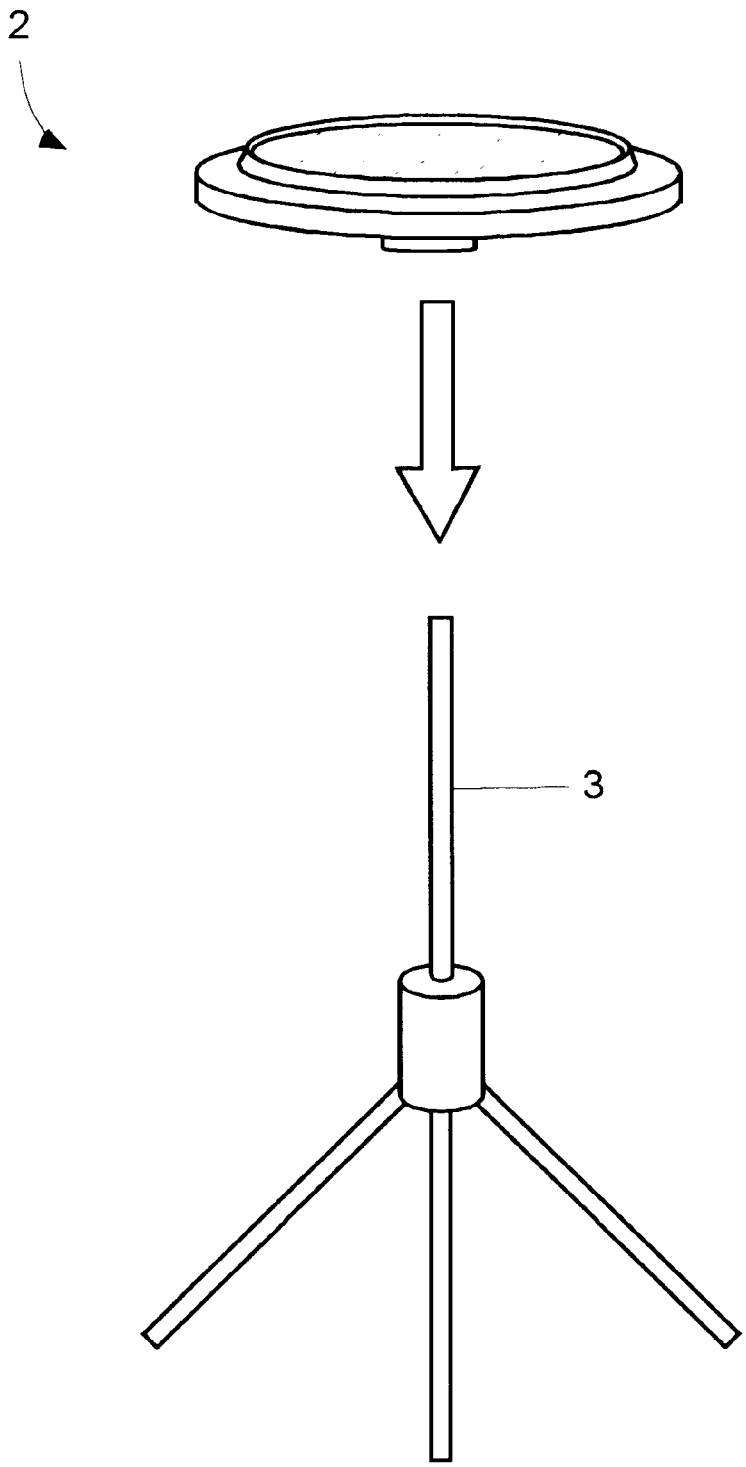
FIG. 2 is a front perspective drawing of the conventional drum of FIG. 1 prior to seating the practice pad 2 thereon.

As shown in FIG. 2, the practice pad 2 is removably anchored to the stand 3 such as, for instance, by screwing directly therein. Alternatively, the practice pad 2 may be adapted for laying on any flat surface (including the drumskins of existing drums) for impromptu practice sessions. Under normal use, the pad 2 will not mar delicate surfaces including wood or plastic or leather.

Figure 3:
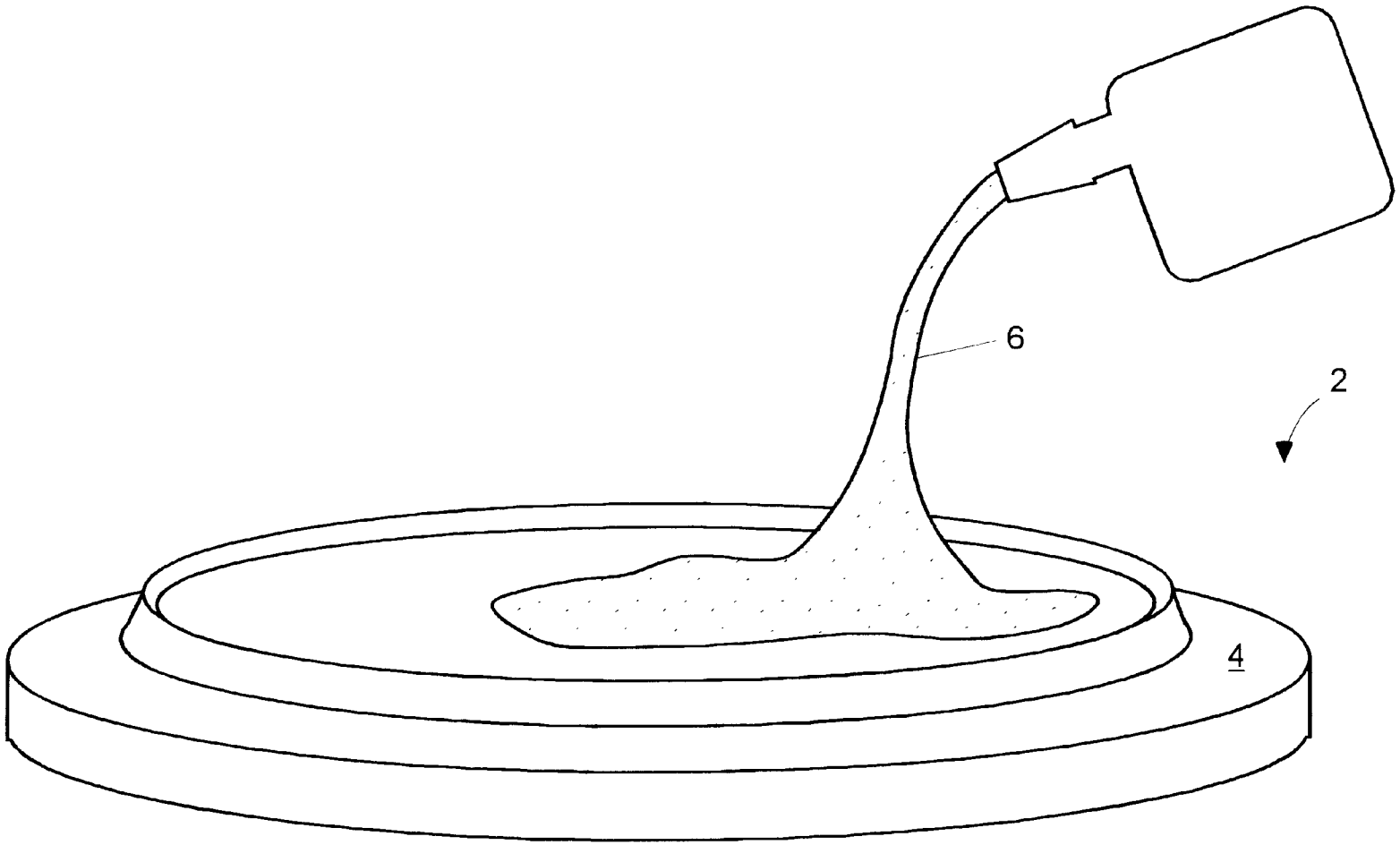
FIG. 3 is an enlarged perspective view of the practice pad mounting 4 with pad compound 6 being poured therein.

FIG. 3 is an enlarged perspective view of the base 4 of practice pad 2 with elastomeric pad compound 6 being poured therein. The base 4 may be formed of molded plastic, metal (preferably aluminum alloy), hardwood, or other suitable material. Base 4 generally comprises a disk defined by a shallow circular recess spanning most of the upper surface. Liquid elastomeric pad compound 6 is poured into the recess, and there it self-levels and hardens in a thin layer to provide a striking surface.

In accordance with the process of the present invention, pad compound 6 is formed from at least a two part elastomer mixture comprising approximately eight parts of a liquid elastomer (Part A), and approximately one part liquid catalyst (e.g., 800 grams resin with 100 grams catalyst). These ratios may be varied somewhat and is has been found that ratios of 8/1 to 10/1 will suffice.

Part A is a mixture comprising primarily calcined kaolin (an aluminum silicate), with smaller amounts of aryl mercurial (up to 0.45%), and coloring agents such as yellow, red, black and/or blended iron oxides. Suitable variants of Part A have been sold under the tradenames Chemturf and Proturf.

Part B is a urethane catalyst, for example, Coscat B which is sold by Cosan Chemical Company in Carlstadt, N.J. (specification/product safety sheets for this component is attached.).

The eight Parts A and one Part B are combined and mixed for one minute using conventional mixing device. Further pigments or dyes can be added at this point to produce an aesthetically pleasing striking surface. The mixed elastomer 6 is then poured into the recess at the top of the base 4. The volume of poured elastomer 6 is preferably sufficient to yield a ⅝" thick striking surface regardless of the diameter of pad 2. This thickness is considered to give the best combination of strike "feel" and sound muffling qualities.

The poured elastomer 6 self-levels across the recess of base 4, adheres thereto, and permanently bonds to the base 4 surface without the need for further adhesives or bonding agents.

The elastomer mixture is then allowed to cure for between 1 to 4 hours depending on the ambient temperature, humidity, and other factors. The preferred curing temperature range is 75–80 degrees F. Once fully cured, the elastomer is stable at 800 psi and at a Durometer rating of 45–55.

After the curing process is complete, an optional company logo or other printed design may be applied to the striking surface.

Finally, a thin coating of clear high-gloss polyurethane is sprayed over the striking surface. Once dry, this coating eliminates "pulling" of the drumstick, e.g., the striking surface will not seem tacky or adhesive to the drumstick. The gloss also enhances the appearance of the pad.

At this point, the pad 2 according to the present invention is ready for use. The pad will remain useable indefinitely since it is much more durable than conventional rubber pads. The elastomer striking surface will not wear out or become depressed. Moreover, the process for making the pad 2 is well-suited for economical mass production since it is simple and employs readily available materials.

Figure 4:
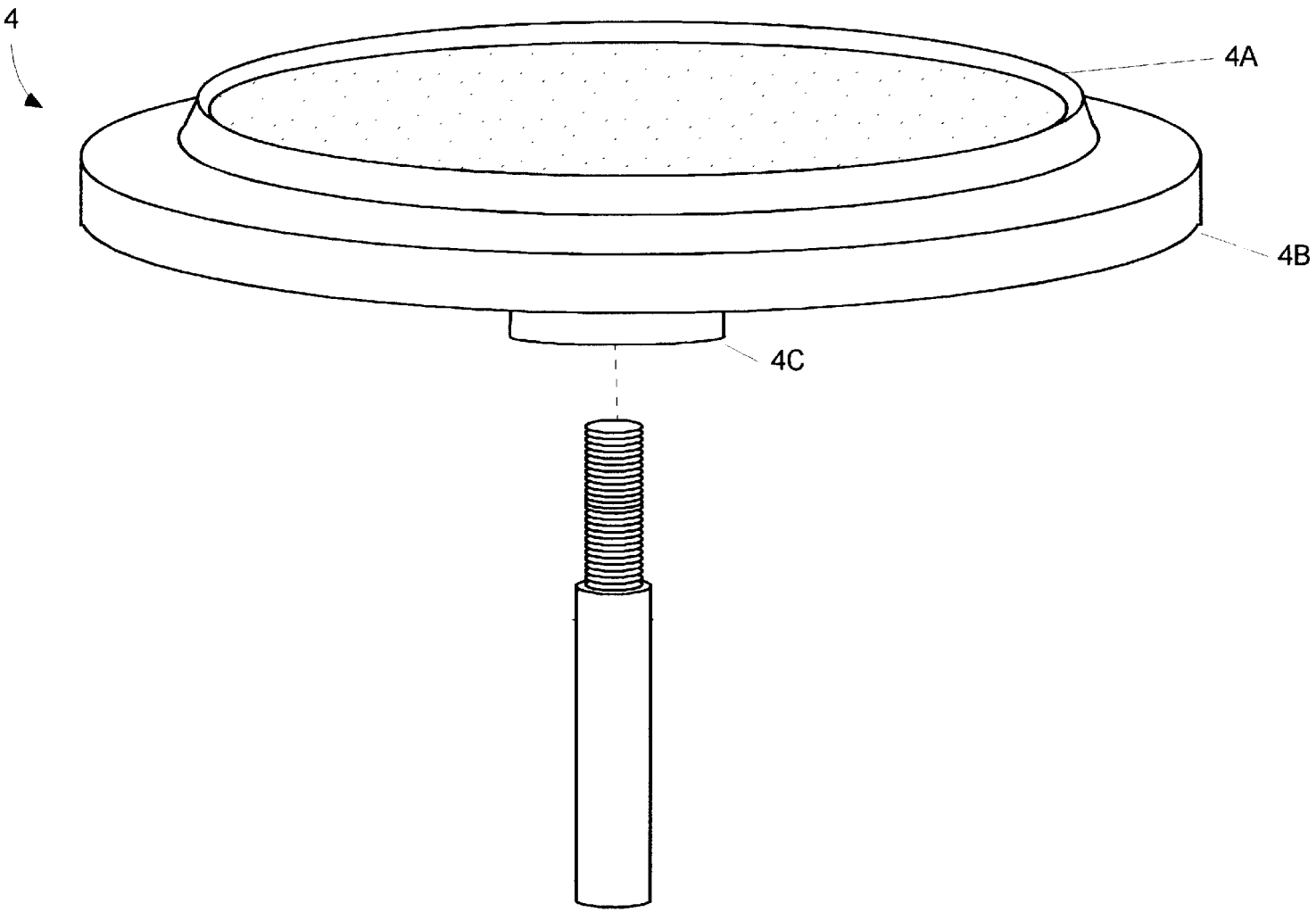
FIG. 4 is an exploded view of the components 4A–D which may be assembled into practice pad 4.

FIG. 4 is an enlarged view of the presently preferred base 4. The base 4 is preferably a single-piece unit formed of anodized aluminum and can be anodized in different colors to add visual contrast to the elastomer 6. Alternately, the base 4 may be formed of molded plastic, other metals, hardwood, or other suitable material. The base 4 generally comprises a disk mid-section 4B, a peripheral rim 4A rising above mid-section 4B, a shallow circular recess inside rim 4A and spanning most of the upper surface of the base 4 (liquid pad compound 6 is poured into the recess), and a lower neck 4C.

Lower neck 4C protrudes downwardly from the bottom of practice pad 2 and is provided with a threaded central bore-hole to facilitate mounting. This way, the practice pad 2 can be securely anchored to a conventional threaded instrument stand or other position-holding fixture.

The above-described pad 2 offers the "ultimate in transition from drum head to practice pad" by very closely simulating an actual drum head. The striking surface is as close to actual drumskin as possible, and thereby allowing more efficient practice in the following areas: stick control on the pad surface; finger and hand development; uniform stick response, and rebound. Moreover, it is envisioned that the smoother response of the pad 2 will reduce hand and nerve related injuries and subsequent syndromes, all coming from repetitive stress on the hands arid wrists. The pad 2 promotes the ability to practice for extended periods of time.

Figure 5:
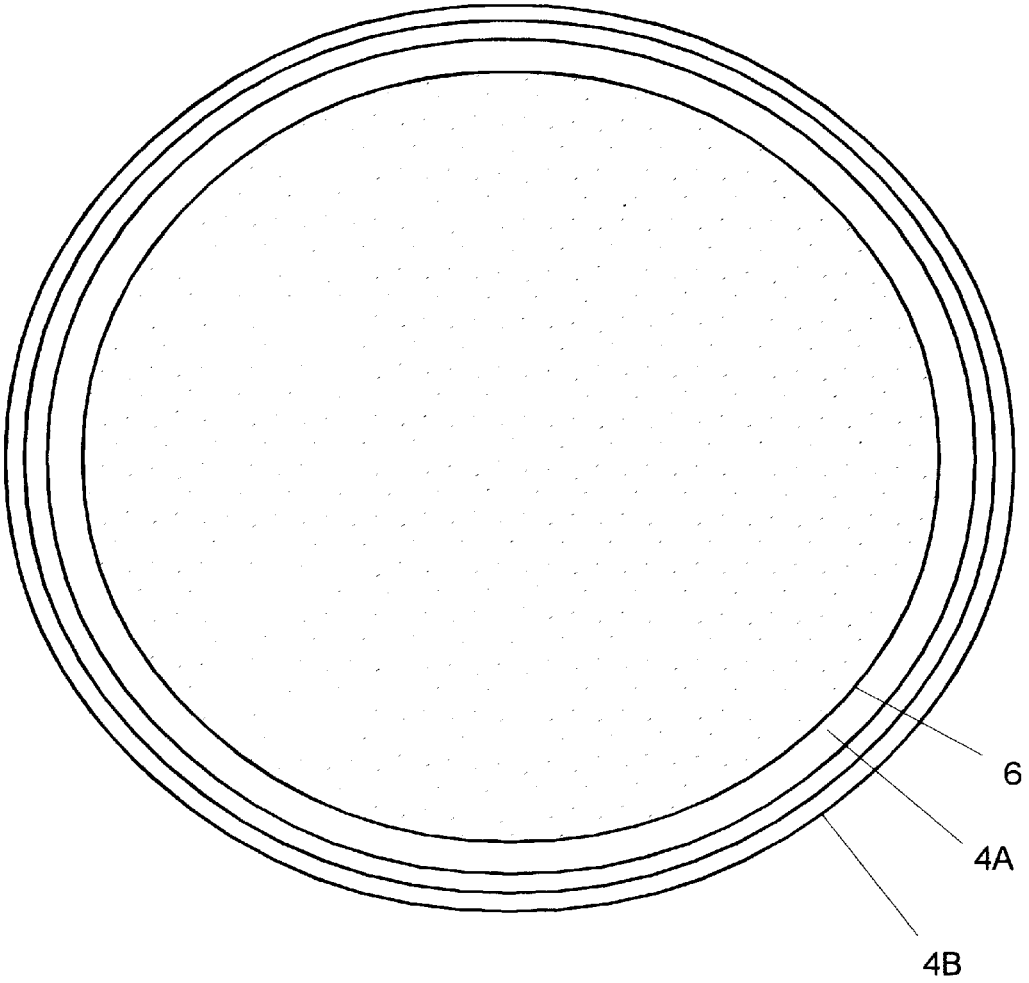
FIG. 5 is a top view of the practice pad 2.

FIG. 5 is a top view of the practice pad 2.

Figure 6:
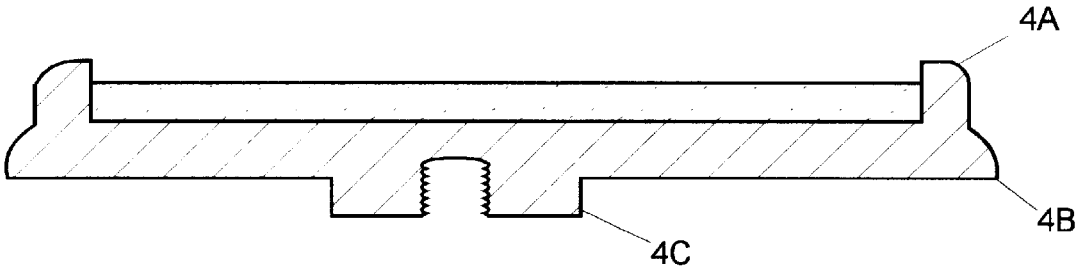
FIG. 6 is a side cross-section of the practice pad 2.

FIG. 6 is a side cross-section of the practice pad 2. The presently preferred thickness (from top of rim 4A to bottom of mid-section 4B) is one (1) inch, to which neck 4C adds another ¾ inch. The depth of the recess into which elastomer 6 is poured is preferably about ¾ inch and this is sufficient to yield the ⅝" thick striking surface.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. A drummer's practice pad, comprising:

a base having a shallow upper recess;

an elastomer pad seated in said base recess to provide a striking surface, said pad further comprising a hardened compound formed of calcined kaolin and aryl mercurial, and a urethane catalyst.

2. A method for making a drummer's practice pad, comprising the steps of:

mixing eight parts of a mixture of calcined kaolin and aryl mercurial with one part of a mixture of urethane catalyst;

pouring said mixture into a base in a shallow upper recess thereof;

allowing said mixture to cure for between 1 to 4 hours and within a temperature range of 75–80 degrees F.;

whereby said cured mixture bonds to said base and forms a drum practice pad.

* * * * *